US010196849B2

(12) United States Patent
Oda

(10) Patent No.: US 10,196,849 B2
(45) Date of Patent: Feb. 5, 2019

(54) DOOR OPENING/CLOSING SYSTEM WITH DOOR OPERATED BY ELECTRIC MOTOR

(71) Applicant: FANUC CORPORATION, Yamanashi (JP)

(72) Inventor: Masaru Oda, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 0 days.

(21) Appl. No.: 14/691,978

(22) Filed: Apr. 21, 2015

(65) Prior Publication Data

US 2015/0308177 A1 Oct. 29, 2015

(30) Foreign Application Priority Data

Apr. 24, 2014 (JP) ..... 2014-090425

(51) Int. Cl.

| | |
|---|---|
| ***E05F 15/41*** | (2015.01) |
| ***E05F 15/42*** | (2015.01) |
| ***E05F 15/632*** | (2015.01) |
| ***E05F 15/70*** | (2015.01) |
| *E05F 15/79* | (2015.01) |

(52) U.S. Cl.

CPC ..... *E05F 15/41* (2015.01); *E05F 15/42* (2015.01); *E05F 15/632* (2015.01); *E05F 15/70* (2015.01); *E05F 15/79* (2015.01)

(58) Field of Classification Search

CPC ..... B23Q 11/0078; B23Q 11/0082; B23Q 11/0089; B23Q 11/0092; E05F 15/41

See application file for complete search history.

(56) References Cited

U.S. PATENT DOCUMENTS

| | | | | |
|---|---|---|---|---|
| 4,535,569 A | | 8/1985 | Blanc et al. | |
| 4,625,291 A | * | 11/1986 | Hormann | E05F 15/41 318/265 |
| 5,302,061 A | * | 4/1994 | Terawaki | B23Q 7/04 408/67 |
| 5,536,137 A | * | 7/1996 | Jager | B23Q 1/66 414/788.7 |

(Continued)

FOREIGN PATENT DOCUMENTS

| | | | |
|---|---|---|---|
| CN | 201264082 | Y | 7/2009 |
| CN | 102261210 | A | 11/2011 |

(Continued)

OTHER PUBLICATIONS

English Abstract for Japanese Publication No. 2008-207270 A, published Sep. 11, 2008, 1pg.

(Continued)

*Primary Examiner* — Catherine A Kelly
(74) *Attorney, Agent, or Firm* — Fredrikson & Byron, P.A.

(57) ABSTRACT

A door opening/closing system comprising: an electric motor which drives opening/closing operation of a door, a detection part which detects a load torque which is applied to the electric motor while the electric motor is driving the opening/closing operation of the door, a judgment part which judges if the detected load torque exceeds a preset reference value, and a stop control part which stops the electric motor by controlling the electric motor so as to generate a drive torque in the same direction as the detected load torque when the detected load torque exceeds the reference value.

5 Claims, 3 Drawing Sheets

(56) References Cited

U.S. PATENT DOCUMENTS

| | | | | | |
|---|---|---|---|---|---|
| 5,764,008 | A * | 6/1998 | Hahn | B60J 7/0573 | 318/256 |
| 6,183,040 | B1 * | 2/2001 | Imaizumi | H02H 7/0851 | 296/155 |
| 6,326,751 | B1 * | 12/2001 | Mullet | E05D 13/00 | 318/266 |
| 7,373,754 | B2 * | 5/2008 | Albiero | E05F 15/44 | 200/61.43 |
| 7,552,965 | B2 * | 6/2009 | Radmanic | B60J 7/0573 | 296/216.06 |
| 7,843,153 | B2 * | 11/2010 | Held | E05F 15/41 | 318/255 |
| 8,729,837 | B2 * | 5/2014 | Tandrow | G05B 19/19 | 318/268 |
| 8,843,278 | B2 * | 9/2014 | Koberstaedt | B60J 5/101 | 701/33.9 |
| 8,975,850 | B2 * | 3/2015 | Hirota | H02K 7/14 | 318/266 |
| 2005/0210752 | A1 * | 9/2005 | Schulte | E05F 1/046 | 49/360 |
| 2014/0239867 | A1 * | 8/2014 | Bessho | H02H 7/0851 | 318/466 |

FOREIGN PATENT DOCUMENTS

| | | | |
|---|---|---|---|
| CN | 103314171 | A | 9/2013 |
| CN | 103382897 | A | 11/2013 |
| DE | 10339260 | A1 | 3/2005 |
| JP | H0574744 | U | 10/1993 |
| JP | 7310473 | A | 11/1995 |
| JP | 9507999 | A | 8/1997 |
| JP | 2001231281 | A | 8/2001 |
| JP | 2001349142 | A * | 12/2001 |
| JP | 200675916 | A | 3/2006 |
| JP | 200683526 | A | 3/2006 |
| JP | 2008207270 | A | 9/2008 |
| JP | 2013122157 | A | 6/2013 |

OTHER PUBLICATIONS

English Machine Translation for Japanese Publication No. H05-74744 U, published Oct. 12, 1993, 4 pgs.
English Abstract and Machine Translation for Japanese Publication No. 2013-122157 A, published Jun. 20, 2013, 18 pgs.
English Abstract and Machine Translation for Japanese Publication No. 2006-083526 A, published Mar. 30, 2006, 10 pgs.
English Abstract and Machine Translation for Japanese Publication No. 2006-075916 A, published Mar. 23, 2006, 14 pgs.
English Abstract and Machine Translation for Japanese Publication No. 2001-231281 A, published Aug. 24, 2001, 12 pgs.
English Abstract and Machine Translation for Japanese Publication No. 09-507999 A, published Aug. 12, 1997, 8 pgs.
English Abstract and Machine Translation for Japanese Publication No. 07-310473 A, published Nov. 28, 1995, 10 pgs.
English Abstract and Machine Translation for Chinese Publication No. 102261210 A, published Nov. 30, 2011, 9 pgs.
English Abstract and Machine Translation for Chinese Publication No. 103382897 A, published Nov. 6, 2013, 18 pgs.
English Abstract and Machine Translation for Chinese Publication No. 103314171 A, published Sep. 18, 2013, 17 pgs.
English Abstract and Machine Translation for Chinese Publication No. 201264082 Y, published Jul. 1, 2009, 6 pgs.
English Abstract and Machine Translation for German Publication No. 10339260 A1, published Mar. 24, 2005, 6 pgs.

* cited by examiner

DOOR OPENING/CLOSING SYSTEM WITH DOOR OPERATED BY ELECTRIC MOTOR

BACKGROUND OF THE INVENTION

1. Field of the Invention

The present invention relates to a door opening/closing system which comprising a door which is operated by an electric motor.

2. Description of the Related Art

NC lathes and machining centers and other machine tools are often surrounded by external covers which prevent scattering to the surrounding environment of the machining fluid which is used for processing of a workpiece and the swarf which is produced during processing of a workpiece. Normally, the external cover of a machine tool comprises an automatically operating door. The door is closed while the workpiece is processed, but the door is opened while workpieces are changed. Further, a workpiece on a work table is changed by an automatic changing system which is installed adjoining the machine tool. In relation to this, JP-A-2008-207270 proposes a door device for machine tool which comprises a slide door which is driven to open/close by a pneumatic cylinder, and a brake which is driven by another pneumatic cylinder to stop the slide door. More specifically, the door device of JP-A-2008-207270 is designed to start the feed of air to the pneumatic cylinder for the brake, simultaneously with stopping the feed of air to the pneumatic cylinder for the slide door, when the slide door strikes an obstacle. Further, JP-U-H05-74744 proposes an automatically opening/closing door device which comprises a main door which is driven by an air cylinder, and a small sized, light weight subdoor which is driven by an air cylinder with a smaller thrust force than the main door. More specifically, the door device of JP-U-H05-74744 can close the main door only when the subdoor is closed. This ensures that a user is prevented from being caught in the large sized, heavy weight main door.

However, it is difficult to precisely control the operation of a pneumatic door, and therefore, to prevent a pneumatic door from striking an obstacle and being damaged, it is necessary to maintain a low operating speed of the door. For this reason, if the door device of JP-A-2008-207270 is employed, the cycle time for changing a workpiece of a machine tool is liable to become longer. Further, two pneumatic circuits for the slide door and for the brake are necessary in the device of JP-A-2008-207270, and a subdoor is required in addition to a main door in the device of JP-U-H05-74744. Therefore, the device as a whole becomes complicated in structure and its manufacturing cost is increased.

A door operating system comprising a door which can be opened/closed at a high speed, and being capable of quickly stopping the door when it strikes an obstacle, has been sought.

SUMMARY OF INVENTION

According to a first aspect of the present invention, there is provided a door opening/closing system comprising an electric motor which drives opening/closing operation of a door, a detection part which detects a load torque which is applied to the electric motor while the electric motor is driving the opening/closing operation of the door, a judgment part which judges if the detected load torque exceeds a preset reference value, and a stop control part which controls the electric motor by controlling the electric motor so as to generate a drive torque in the same direction as the detected load torque when the detected load torque exceeds the reference value.

According to a second aspect of the present invention, there is provided a door opening/closing system in the first aspect, wherein the judgment part performs the judgment repeatedly with a predetermined period while the opening/closing operation of the door is driven by the electric motor.

According to a third aspect of the present invention, there is provided a door opening/closing system in the first or second aspect, wherein a plurality of different values corresponding to positions of the door are set as the reference value.

According to a fourth aspect of the present invention, there is provided a door opening/closing system in any one of the first to third aspects, wherein a plurality of different values corresponding to speeds of movement of the door are set as the reference value.

According to a fifth aspect of the present invention, there is provided a door opening/closing system in any one of the first to fourth aspects, wherein the electric motor is a servo motor.

According to a sixth aspect of the present invention, there is provided a processing system comprising a processing machine which has a door operating system in any one of the first to fifth aspects, and a conveyor device which can perform the operation of loading a workpiece before being processed by the processing machine through the door to the inside of the processing machine, and the operation of unloading a workpiece after being processed by the processing machine through the door to the outside of the processing machine.

According to a seventh aspect of the present invention, there is provided a processing system in the sixth aspect, wherein the conveyor device is a robot.

These and other objects, features, and advantages of the present invention will become clearer with reference to the detailed description of illustrative embodiments of the present invention which are shown in the attached drawings.

DETAILED DESCRIPTION OF EMBODIMENTS

Below, embodiments of the present invention will be explained in detail with reference to the drawings. Note that the following explanation does not limit the technical scope of the inventions which are described in the claims or the meaning of terms etc.

Figure 1:
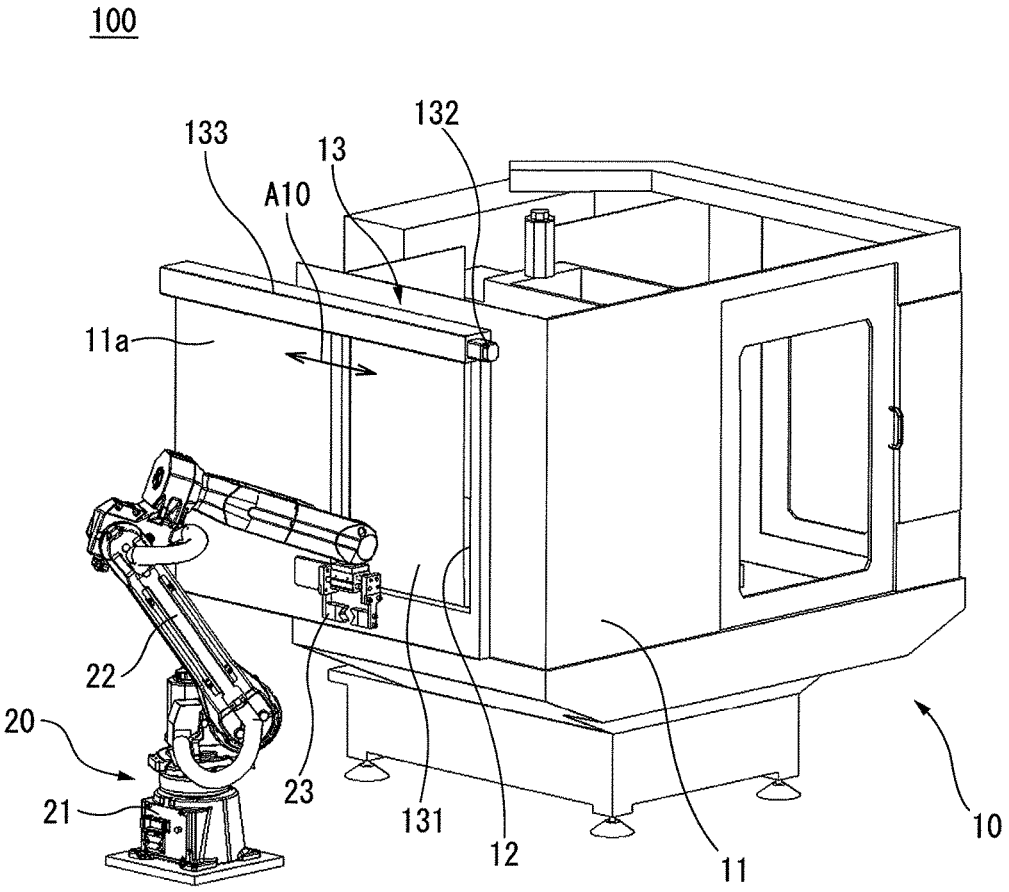
FIG. 1 is a perspective view which shows the appearance of a processing system which includes a door opening/closing system of one embodiment of the present invention.
Figure 2:
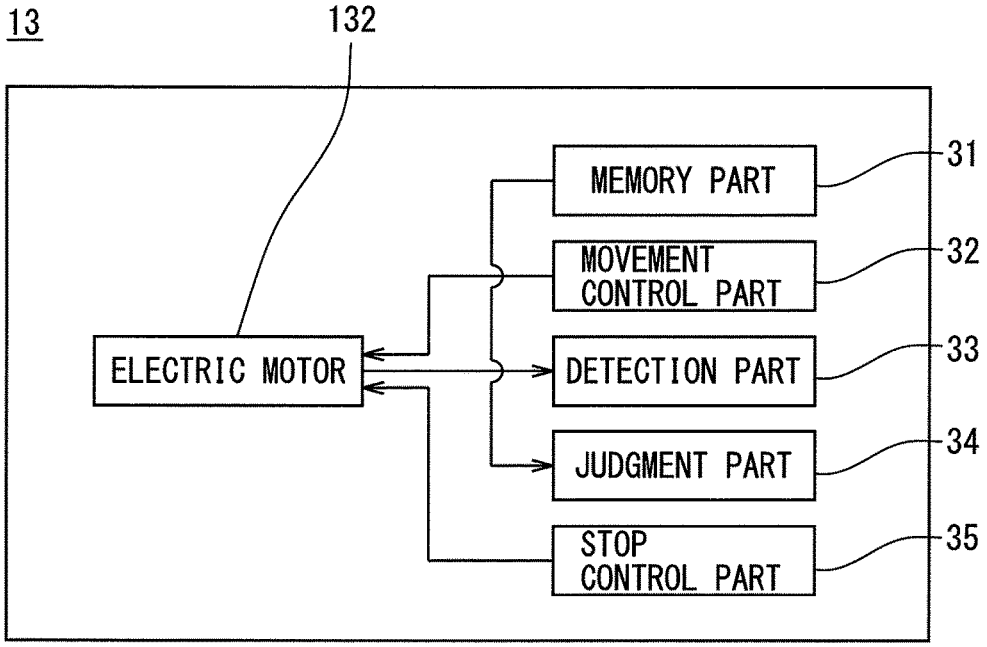
FIG. 2 is a block diagram which shows the system configuration for controlling an electric motor of the door opening/closing system in FIG. 1.
Figure 3:
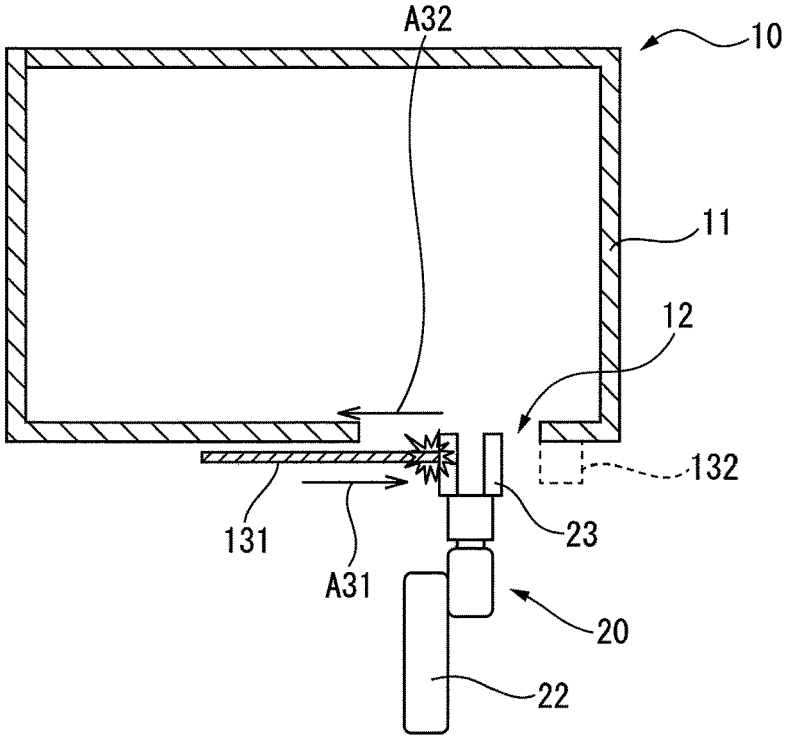
FIG. 3 is a first diagram for explaining a process in which a stop control part in the door opening/closing system of FIG. 2 stops the electric motor on an emergency basis.

Referring to FIG. 1 to FIG. 3, a door opening/closing system of one embodiment of the present invention will be explained. FIG. 1 is a perspective view which shows the appearance of a processing system 100 which includes an illustrative door opening/closing system 13 of the present embodiment. As shown in FIG. 1, the processing system 100 of the present example comprises a processing machine 10, and a conveyor device 20 which is arranged adjoining the processing machine 10.

First, the processing machine 10 of the present example will be explained. The processing machine 10 of the present example is a machining center or NC lathe or other machine tool which processes various workpieces. As shown in FIG. 1, the processing machine 10 of the present example is surrounded by an external cover 11 which prevents scattering to the surrounding environment of the machining fluid which is used during processing of a workpiece and the swarf which is produced during processing of the workpiece. The facing surface 11*a* of the external cover 11 which faces the conveyor device 20 is provided with an opening part 12 which communicates between the inside and outside of the external cover 11. Further, a door opening/closing system 13 for opening/closing the opening part 12 is attached to the facing surface 11*a* of the external cover 11. The door opening/closing system 13 of the present example will be explained in detail below.

As shown in FIG. 1, the door opening/closing system 13 of the present example comprises a rectangular plate-shaped door 131 which is attached to the external cover 11 so as to be able to move back and forth along the direction which is shown by the arrow A10 in the figure, an electric motor 132 which is fastened to a location adjoining the opening part 12 of the external cover 11, and an opening/closing mechanism 133 which is connected to both the shaft of the electric motor 132 and door 131 so as to transmit a rotational drive force of the electric motor 132 to the door 131. Here, the electric motor 132 of the present example is a synchronous type AC servo motor, induction type AC servo motor, DC servo motor, or other of various servo motors, and is provided with an encoder or resolver or other of various detectors. The information relating to the position and speed of the shaft detected by the detector of the electric motor 132 can be used for feedback control of the electric motor 132 by the later explained movement control part 32.

Further, the opening/closing mechanism 133 of the present example is a ball screw comprising a threaded shaft which is attached to the external cover 11, and a nut which is fastened to the door 131 through a bracket so as to be able to rotate about the axial line parallel to the direction which is shown by the arrow A10 in the figure. Further, the threaded shaft of the opening/closing mechanism 133 of the present example is coupled with the shaft of the electric motor 132 so as to rotate in conjunction with the shaft of the electric motor 132. This ensures that rotational motion of the shaft of the electric motor 132 is converted to linear motion of the door 131. That is, the door 131 of the present example is configured to be able to move back and forth between an open position where the opening part 12 is completely opened, and a closed position where the opening part 12 is completely closed by the drive force of the electric motor 132 which is transmitted through the opening/closing mechanism 133. Note that, FIG. 1 shows the door 131 located at the closed position.

Next, the conveyor device 20 of the present example will be explained. As shown in FIG. 1, the conveyor device 20 of the present example is a vertical articulated robot comprising a base 21 which is fastened to the floor, an arm 22 which is attached to the base 21 so as to be able to turn about a predetermined swivel axis, and a hand 23 which is attached to the front end part of the arm 22 so as to be able to rotate about a predetermined rotation axis. Further, the conveyor device 20 of the present example is designed so that the base 21 and the arm 22 cooperate to change the position and posture of the hand 23 and thereby convey various articles gripped by the hand 23 between the inside and outside of the door 131.

More specifically, the conveyor device 20 of the present example can operate to load an unprocessed workpiece to the inside of the processing machine 10 by moving the hand 23 which grips the unprocessed workpiece from the opening part 12 to the inside of the external cover 11 when the door 131 is in the open position, and can also operate to unload the processed workpiece to the outside of the processing machine 10 by moving the hand which grips the processed workpiece from the opening part 12 to the outside of the external cover 11. Below, the former operation of the conveyor device 20 will be called the "loading operation", while the latter operation will be called the "unloading operation". Note that, the conveyor device 20 in the processing system 100 of the present embodiment may be any mechanical apparatus so long as it can perform both the above-mentioned loading operation and unloading operation. For example, it may also be a horizontal articulated robot or orthogonal robot or other type of robot.

Next, the system configuration of the door opening/closing system 13 of the present embodiment will be explained. FIG. 2 is a block diagram which shows one example of the system configuration for controlling the electric motor 132 of the door opening/closing system 13 in FIG. 1. As shown in FIG. 2, the door opening/closing system 13 of the present example has, as component elements for controlling the electric motor 132, a memory part 31, movement control part 32, detection part 33, judgment part 34, and stop control part 35. These elements will be explained in order below. First, the memory part 31 of the present example is a ROM or RAM or other data storage region for storing various data including reference values of load torques described later.

Next, the movement control part 32 of the present example has the function of generating and transmitting to the electric motor 132, a control signal for moving the door 131 from the closed position to the open position, and a control signal for moving the door 131 from the open position to the closed position. Further, the electric motor 132 which received the former control signal moves the door 131 from the closed position at a constant speed after accelerate the door 131 with a certain amount of acceleration, and then stops the door 131 at the open position after moving the door 131 at a constant speed and decelerating it with a certain amount of deceleration. Similarly, the electric motor 132 which received the latter control signal moves the door 131 from the open position at a constant speed after accelerating the door 131 with a certain amount of acceleration, and then stops the door 131 at the closed position after moving the door 131 at a constant speed and decelerating it with a certain deceleration. During this, feedback control is performed based on the information which is acquired from the electric motor 132 side detector, and therefore the drive torque and rotational speed etc. of the electric motor 132 can be adjusted precisely and easily. This ensures that the acceleration and speed of movement etc. of the door 131 can be adjusted precisely and easily. The former control signal is, for example, generated after the processing machine 10 finishes processing the workpiece, while the latter control signal is, for example, generated after the conveyor device 20 finishes the loading operation or unloading operation of the workpiece.

Next, the detection part 33 of the present example has the function of detecting the load torque which is applied to the electric motor 132. The "load torque" referred to herein includes both the torque due to the frictional force which is applied to various parts of the door 131 and opening/closing mechanism 133, and the torque due to external force which is applied to various parts of the door 131 and opening/closing mechanism 133. More specifically, the detection part 33 of the present example measures the electrical current which flows through the electric motor 132, and detects the load torque based on the measured value. That is, the detection part 33 of the present example detects the load torque applied to the electric motor 132, using the characteristic of the electrical current through the servo motor increasing in accordance with the load torque applied to the servo motor. However, the detection part 33 may also use a different technique from the above-mentioned technique in order to detect the load torque applied to the electric motor 132. For example, the detection part 33 may use a strain gauge or other sensor which is attached to a shaft of the electric motor 132 in order to measure the magnitude of the strain which occurs in the shaft, and detect the load torque based on the measured value. Note that, in this specification, the torque generated by the drive force of the electric motor 132 will be called the "drive torque" in order to differentiate it from the above load torque.

Next, the judgment part 34 of the present example has the function of judging if the load torque detected by the above detection part 33 exceeds the reference value which is stored in advance in the memory part 31. Further, the judgment part 34 of the present example repeatedly performs the above judgment with a predetermined period while the electric motor 132 drives the opening/closing operation of the door 131 in accordance with the control signal of the movement control part 32. The result of judgment by the judgment part 34 is transmitted to the stop control part 35. The reference value of the above-mentioned load torque is, for example, larger than the maximum value of the load torque which can be generated by the frictional force applied to various parts of the moving door 131 and opening/closing mechanism 133, and is smaller than the minimum value of the load torque which can be generated by the reaction force applied from the obstacle to the door 131 when the moving door 131 collides with an obstacle which is positioned at the front in the direction of advance. Therefore, it is possible to judge if the moving door 131 has collided with an obstacle based on the result of judgment of the judgment part 34. That is, when the load torque which is detected by the detection part 33 exceeds the reference value, it is determined that the moving door 131 has collided with an obstacle. The "obstacle" referred to herein includes the arm 22 or hand 23 of the conveyor device 20, various parts of the body of the worker, and a workpiece etc. dropping from the hand 23 of the conveyor device 20.

Note that, the predetermined reference value of the load torque does not have to be a single value which is unchanged over the entire stroke of movement of the door 131 by the electric motor 132. That is, a plurality of difference reference values corresponding to positions of the door 131 in the above stroke of movement may also be defined. Here, right after the door 131 starts moving from the open or closed position, that is, while the electric motor 132 is accelerated, the drive torque of the electric motor 132 is gradually increased. Further, as the door 131 approaches a constant speed, the drive torque of the electric motor 132 is gradually decreased. While the door 131 moves at a constant speed, the drive torque of the electric motor 132 is kept substantially constant at a relatively small value. Further, right before the moving door 131 toward the closed or open position is stopped, that is, while the electric motor 132 is decelerated, the electric motor 132 generates a drive torque in a direction opposite to the direction of rotation up to then. More specifically, when the door 131 starts to be decelerated, the drive torque of the electric motor 132 is gradually increased in the opposite direction. Further, as the speed of the door 131 is decreased, the drive torque of the electric motor 132 is gradually decreased to nearly zero from a large value in the opposite direction.

If considering these facts, for example, it may be useful to set the reference value such that it is gradually increased and then gradually decreased from when the door 131 starts to move from the open or closed position until when the door 131 reaches a constant speed, and useful to set the reference value such that it is kept constant at a relatively small speed while the door 131 is moving at a constant speed. Further, in the period right before the door 131 is stopped, it may be useful to set the reference value such that it is gradually increased in the opposite direction right after the door 131 starts to be decelerated, and it is gradually decreased to nearly zero as the speed of movement of the door 131 is decreased. Further, if the speed of movement of the door 131 is increased, the drive torque of the electric motor 132 is increased, while if the speed of movement of the door 131 is decreased, the drive torque of the electric motor 132 is decreased. In consideration of this fact, it may be useful to set a plurality of different reference values corresponding to the speeds of movement of the door 131. In this case, it may be useful to set the reference value such it is increased as the speed of movement of the door 131 is increased, and it is decreased as the speed of movement of the door 131 is decreased.

Next, the stop control part 35 of the present example has the function of stopping on an emergency basis the electric motor 132 which is driving the opening/closing operation of the door 131 in accordance with a control signal of the movement control part 32, based on the result of judgment of the judgment part 34. More specifically, the stop control part 35 of the present example generates and transmits to the electric motor 132, a control signal for generating a drive torque in the same direction as the direction of rotation by the load torque when the load torque detected by the detection part 33 exceeds a reference value. Therefore, when the load torque detected by the detection part 33 exceeds a reference value, the electric motor 132 generates a drive torque for rotating the shaft in a direction opposite to the direction of rotation up to then. The magnitude of the thus generated drive torque may be equal to the maximum value of the drive torque which can be outputted by the electric motor 132. This ensures that the rotating electric motor 132 and hence the moving door 131 are quickly stopped, and therefore it is possible to prevent damage to the door 131 and the obstacle which is struck by the door 131 (for example, hand 23 of conveyor device 20).

Next, an outline of the operation of the electric motor 132 in the door opening/closing system 13 of the present embodiment will be explained. FIG. 3 is a first diagram for explaining the process in which the stop control part 35 in the door opening/closing system 13 of FIG. 2 stops the electric motor 132 on an emergency basis, and shows a cross-section of the processing machine 10 in FIG. 1 along the horizontal direction. However, FIG. 3 omits the structural parts of the processing machine 10 at the inside of the external cover 11 and the opening/closing mechanism 133 etc. of the door opening/closing system 13. As shown in FIG. 3, if a door 131 moving from the open position toward the closed position in the direction of the arrow A31 strikes the hand 23 of the conveyor device 20 which is positioned in the front in the direction of advance, the shaft of the electric motor 132 is subjected to a load torque in a direction opposite to the direction of rotation up to then, because of the reaction force which is applied from the obstacle, i.e., the hand 23 to the door 131. That is, the shaft of the electric motor 132 is subjected to a load torque for moving the door 131 in the direction of the arrow A32. As explained above, the judgment part 34 of the present example repeatedly judges if the load torque which applied to the electric motor 132 exceeds the reference value with a predetermined period, and therefore the result of judgment by the judgment part 34 is transmitted to the stop control part 35 right after the door 131 strikes the hand 23.

Figure 4:
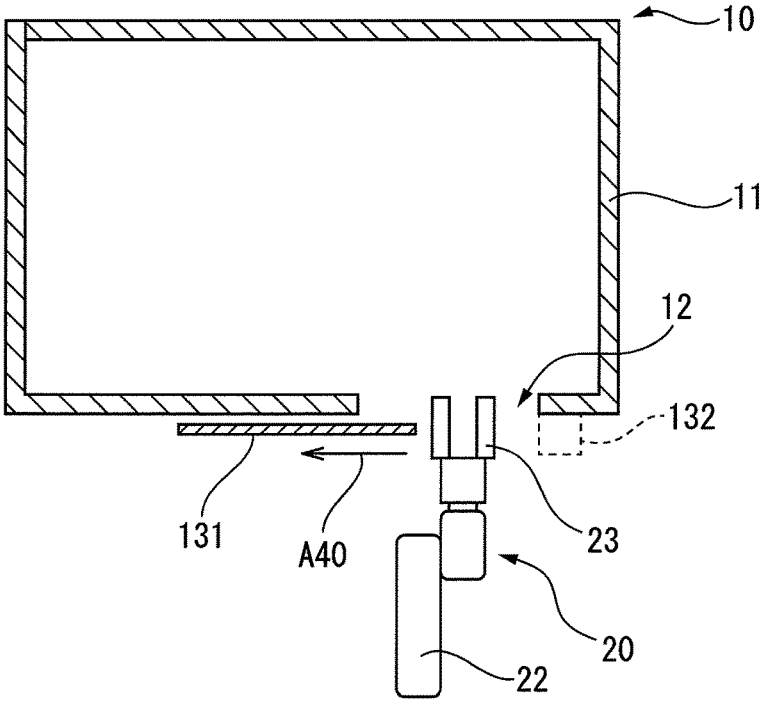
FIG. 4 is a second diagram for explaining a process in which a stop control part in the door opening/closing system of FIG. 2 stops the electric motor in an emergency.

FIG. 4 is a second diagram for explaining the process in which the stop control part 35 in the door opening/closing system 13 of FIG. 2 stop the electric motor 132 on an emergency basis, and shows a cross-section similar to FIG. 3. As explained above, if the stop control part 35 of the present example receives the result of judgment which indicates that the load torque applied to the electric motor 132 has exceeded the reference value, the stop control part 35 generates and transmits to the electric motor 132, a control signal for generating a drive torque in the same direction as that load torque. Further, the electric motor 132 which receives the control signal of the stop control part 35 generates a drive torque in the same direction as the load torque which is applied to the shaft, that is, a direction opposite to the direction of rotation up to then, to stop the shaft. If the door 131 which is moving from the open position toward the closed position strikes an obstacle, as shown by the arrow A40 of FIG. 4, the electric motor 132 generates a drive torque in a direction for moving the door 131 to the open position. This ensures that the door 131 is quickly stopped, and it is possible to prevent damage to the door 131 and the hand 23.

Note that, as will be understood from FIG. 4, when the door 131 strikes the hand 23, the door 131 stops after moving relatively in the direction away from the hand 23 by exactly a small distance. However, the stop control part 35 of the present example may control the electric motor 132 so that the door 131 stops at a position further away from the hand 23, or control the electric motor 132 so that the door 131 stops after moving up to the open position. This ensures that a sufficient distance is secured between the door 131 and the hand 23, and therefore it is possible to prevent the door 131 from striking the hand 23 again.

FIG. 3 and FIG. 4 illustrate the operation of the electric motor 132 during which the door 131 moves from the open position toward the closed position to strike an obstacle. However, the electric motor 132 operates in the same way even when the door 131 moves from the closed position toward the open position to strike an obstacle. That is, when the door 131 moves from the closed position toward the open position to strike an obstacle, the electric motor 132 generates a drive torque in a direction for moving the door 131 toward the closed position. In this case as well, the door 131 is quickly stopped, and therefore it is possible to prevent damage to the door 131 and the obstacle.

Effect of Invention

According to the first aspect of the present invention, when the load torque of the electric motor exceeds a reference value, the electric motor generates a drive torque in the same direction as the load torque so as to stop the shaft of the electric motor and the door. Therefore, according to the first aspect, it is possible to quickly stop the door if it strikes an obstacle while being driven by the electric motor, and therefore it is possible to prevent damage to the door due to the reaction force which is applied from the obstacle to the door.

According to the second aspect of the present invention, judgment of whether the load torque has exceeded the reference value is repeated during the opening/closing operation of the door, and therefore it is possible to quickly stop the door no matter where the door strikes an obstacle in the stroke of movement.

According to the third aspect of the present invention, it is possible to set different reference values corresponding to the position of the door in the stroke of movement, and therefore even if the magnitude of the reaction force applied to the door when the door strikes an obstacle changes in accordance with the position of the door, it is possible to reliable judge if the door strikes an obstacle.

According to the fourth aspect of the present invention, it is possible to set different reference values corresponding to the speed of movement of the door, and therefore even if the speed variation of the door is relatively large, it is possible to reliably judge if the door strikes an obstacle.

According to the fifth aspect of the present invention, various servo motors may be employed as the electric motor, and therefore it is possible to easily control the rotational speed and drive torque etc. of the electric motor.

According to the sixth aspect of the present invention, the door can be quickly stopped if it strikes the conveyor device while being driven by the electric motor, and therefore it is possible to prevent damages to the door and conveyor device.

According to the seventh aspect of the present invention, various robots such as vertical articulated robots may be employed as the conveyor device, and therefore it is possible to easily construct a processing system with a high degree of freedom.

The present invention is not limited to the above-mentioned embodiments and can be modified in various ways within the scope described in the claims. For example, the processing machine 10 with the door opening/closing system 13 of the present invention is not limited to the above-mentioned machining center or NC lathe or other machine tool, but may be any apparatus so long as it can process various workpieces. The "processing" referred to herein is not limited to only machining, but means making some sort of physical change to a workpiece. Therefore, the processing machine 10 with the door opening/closing system 13 of the present invention may also be a coating apparatus or cleaning apparatus of a workpiece, for example. Further, the opening/closing mechanism 133 in the door opening/closing system 13 of the present invention is not limited to only the mechanism which has the form of a threaded shaft, but may be any mechanism so long as it can convert rotational motion of the electric motor 132 to linear motion of the door 131. For example, the opening/closing mechanism 133 in the door opening/closing system 13 of the present invention may be a rack-and-pinion type of mechanism. Further, the dimensions, shapes, materials, etc. of the above-mentioned parts are only examples. Various dimensions, shapes, materials, etc. can be employed for achieving the effects of the present invention.

The invention claimed is:

1. A door opening and closing system comprising:

an electric motor which drives opening and closing operation of a door, an opening and closing mechanism which transmits a rotational drive force of the electric motor to the door;

a detection part which detects a load torque which is applied to said electric motor while said electric motor is driving the opening and closing operation of said door, a judgment part which judges if the detected load torque exceeds a preset reference value, and a stop control part which stops said electric motor by controlling said electric motor so as to generate a drive torque in the same direction as the detected load torque when the detected load torque exceeds said preset reference value, wherein the load torque includes both a torque due to a frictional force and a torque due to an external force which are applied to either or both of the door and the opening and closing mechanism, and the drive torque is a torque generated by the drive force of the electric motor, wherein the reference value is set such that from when the door starts to move from an open position or a closed position until when the door reaches a constant speed the reference value is first increased in a first direction corresponding to a direction of movement of the door and is then decreased in the first direction, and wherein the reference value is set, in a period right before the door is stopped, such that right after the door starts to be decelerated the reference value is increased in a second direction opposite the first direction, and is then gradually decreased to nearly zero as the speed of movement of the door is decreased, and wherein said judgement part performs said judgement repeatedly with a predetermined period while the opening and closing operation of said door is driven by said electric motor.

2. The door opening and closing system according to claim 1, wherein said electric motor is a servo motor.

3. The door opening and closing system according to claim 1, wherein said electric motor is a servo motor.

4. A processing system comprising:

a processing machine which has the door opening and closing system according to claim 1; and a conveyor device which can perform an operation of loading a workpiece before being processed by said processing machine through said door to an inside of said processing machine, and an operation of unloading the workpiece after being processed by said processing machine through said door to an outside of said processing machine.

5. The processing system according to claim 4, wherein said conveyor device is a robot.

* * * * *